United States Patent [19]

Chang et al.

[11] 4,165,571

[45] * Aug. 28, 1979

[54] SEA SLED WITH JET PUMP FOR UNDERWATER TRENCHING AND SLURRY REMOVAL

[75] Inventors: Nuke M. Chang; Elmer R. Remkes, both of Orange, Calif.

[73] Assignee: Santa Fe International Corporation, Orange, Calif.

[ * ] Notice: The portion of the term of this patent subsequent to Apr. 15, 1992, has been disclaimed.

[21] Appl. No.: 755,733

[22] Filed: Dec. 30, 1976

Related U.S. Application Data

[60] Continuation of Ser. No. 539,530, Jan. 8, 1975, abandoned, which is a division of Ser. No. 413,378, Nov. 6, 1973, Pat. No. 3,877,238.

[51] Int. Cl.[2] ..... E02F 3/88; E02F 5/02; F04F 5/00; F04F 5/46

[52] U.S. Cl. ..... 37/62; 417/174; 417/182

[58] Field of Search ..... 37/61–63; 417/168, 182, 174

[56] References Cited

U.S. PATENT DOCUMENTS

| | | | |
|---|---|---|---|
| 1,228,608 | 6/1917 | Scanes | 417/174 |
| 1,653,027 | 12/1927 | Ward | 37/61 UX |
| 2,879,649 | 3/1959 | Elliott | 37/80 R X |
| 3,468,397 | 9/1969 | Vegeby | 417/174 X |
| 3,786,642 | 1/1974 | Good et al. | 37/62 X |
| 3,816,027 | 6/1974 | Miscovich | 417/184 |
| 3,877,238 | 4/1975 | Chang et al. | 417/183 X |
| 4,022,028 | 5/1977 | Martin | 37/63 X |

*Primary Examiner*—Clifford D. Crowder
*Attorney, Agent, or Firm*—LeBlanc & Shur

[57] ABSTRACT

The sea sled includes a pair of pontoons mounting depending rollers for straddling a pipeline disposed on the sea bottom. Water jets fluidize the sea bottom to form a trench in which the pipeline settles. The slurry formed by the water jets is removed from the trench by the eductor system which includes a pair of conduits each having a suction inlet at its lower end for location within the trench, a discharge at its upper end, a pair of pump nozzles each having an inlet external to the associated conduit and an outlet within the conduit directed toward the corresponding discharge, and a pair of primary nozzles respectively spaced from the inlet ends of the pump nozzles. A high pressure, low volume, fluid is pumped from the surface through the jet nozzles. The fluid emanating from the jet nozzles entrains ambient fluid and delivers low pressure, high volume, fluid through the respective pump nozzles to their corresponding discharges. The action of the pump nozzles in the conduits creates a suction whereby the slurry from the trench is pumped from the trench through the conduit and discharged to opposite sides of the trench.

22 Claims, 10 Drawing Figures

SEA SLED WITH JET PUMP FOR UNDERWATER TRENCHING AND SLURRY REMOVAL

This is a continuation of application Ser. No. 539,530 filed Jan. 8, 1975, now abandoned, which in turn is a Division of Ser. No. 413,378 filed Nov. 6, 1973 now U.S. Pat. No. 3,877,238 issued Apr. 15, 1975.

The present invention relates to a sea sled for entrenching and burying undersea pipeline and particularly relates to an eductor system for removing slurry from the trench whereby pipeline laid along the sea bottom settles into the trench.

Various systems for laying pipelines along the sea bottom have been proposed and utilized in the past, (for example, see U.S. Pat. No. 3,751,927). Certain of these systems provide a sea sled having jet nozzles directed to fluidize the sea bottom and form a trench for receiving the pipeline. Air jet type eductor systems have also been provided for removing the cuttings or slurry formed by the jet nozzles from the trench. Such air jet eductor systems usually comprise a nozzle disposed in the inlet end of a discharge conduit with air being supplied under pressure from a surface floating tender. Air jet eductor systems are very efficient and will lift significant quantities of slurry. However, with the increasing necessity to lay pipelines in deeper water, for example in water depths exceeding 150–200 feet, an air jet eductor system becomes uneconomical. That is, as the water depth increases, the horse power requirements to supply compressed air from the surface increase quite rapidly.

The present invention provides a novel and improved sea sled and eductor system for forming a trench for and burying underwater pipelines, particularly in depths beyond the feasible or practical limits of presently available equipment which minimizes or eliminates problems associated with prior sea sled and eductor systems and provides a novel and improved sea sled and eductor system having various advantages in construction, mode of operation and use in comparison with such prior sea sleds and eductor systems. In considering the problem of entrenching and burying pipelines in deeper water, for example, in water depths beyond 200 feet, a water jet eductor system was proposed to overcome the problems associated with prior air jet systems, and also in order to utilize an available low volume high pressure supply for the eductor. Upon further consideration, however, it was found that utilization of a high pressure water jet would give rise to severe cavitation problems in the throat and mixing region of the eductor conduit. In short, while a high pressure water jet could be utilized, the eductor system per se would have an extremely short life as cavitation effects would destroy the efficiency of the system as well as the equipment itself. Reduced flow rates and pressures from the high pressure water jet were rejected as solutions to the cavitation problem for a number of reasons including the desirability of obtaining a significant predetermined flow rate of slurry removal from the trench.

In accordance with the present invention, the problems of economically removing the slurry from a trench in water depths exceeding about 200 feet and the cavitation problems associated with utilization of a high pressure water jet nozzle are overcome by providing an eductor system having a double nozzle arrangement. Particularly, the present eductor system provides a pair of suction conduits each having an inlet at its lower end for receiving the slurry from the trench and a discharge at its upper end for discharging the slurry into the ambient water astride the trench. A pump nozzle is disposed in each conduit and has an inlet external to the conduit, the inlet being exposed to the ambient water. The outlet of each pump nozzle is disposed within the eductor conduit in a direction toward the conduit discharge. A pair of primary jet nozzles are carried by the sea sled and each is located a predetermined distance from the inlet to a corresponding pump nozzle. Each jet nozzle is provided with high pressure, low volume fluid from the surface floating tender and which fluid flows outwardly from the jet nozzle through the ambient fluid toward the inlet of the corresponding pump nozzle. This high pressure jet expands freely in the ambient fluid and entrains the ambient fluid for delivery through the pump nozzle at low pressure, high volume, into the eductor conduit. This low pressure, high volume, fluid delivery to each eductor conduit creates a suction at the inlets of the conduits whereby slurry from the trench is sucked into the conduit, the entrained fluid and slurry being discharged at the discharges for the conduits. By permitting the high pressure, low volume, jet to expand in the ambient fluid, the high energy available in the jet is reduced with consequent reduction in the tendency of the eductor conduit to pit as a result of cavitation pressures. Consequently, it has been found that by utilizing a high pressure, low volume, fluid source pumped from a surface floating tender through each jet nozzle, a low pressure, high volume, condition occurs through the corresponding pump nozzle which, in turn, creates a satisfactory magnitude of suction at the eductor inlets for removal of the slurry. It will be appreciated that the gap between each primary jet nozzle and the inlet to the corresponding pump nozzle must be chosen such that desired flow rates of slurry removal are provided. Generally, the larger the gap, the lowr the volume of slurry removed and the probability of encountering cavitation problems. The smaller the gap the greater the volume of slurry removed but the greater the probability of cavitation. Consequently, gap distance is a significant factor in the configuration of the eductor.

Accordingly, it is a primary object of the present invention to provide a novel and improved sea sled and eductor system for entrenching and burying underwater pipelines.

It is another object of the present invention to provide a novel and improved sea sled and eductor system for entrenching and burying underwater pipelines in deep water, for example, on the order of 200 feet or more.

It is still another object of the present invention to provide a novel and improved eductor system for burying subsea pipelines.

It is a further object of the present invention to provide a novel and improved sea sled and eductor system for entrenching and burying subsea pipelines utilizing a double nozzle configuration for suctioning the slurry from the trench in which the pipeline is to be laid.

These and further objects and advantages of the present invention will become more apparent upon reference to the following specification, appended claims and drawings wherein:

FIG. 1 is a schematic illustration of a tender barge for handling the sea sled and eductor system of the present invention and illustrating the latter in use on the sea bottom;

FIG. 1*a* is a view similar to FIG. 1 illustrating the tender barge and sea sled positioned for deepwater pipeline entrenching and burying operations with both illustrated under tow from a tug;

Figure 1:
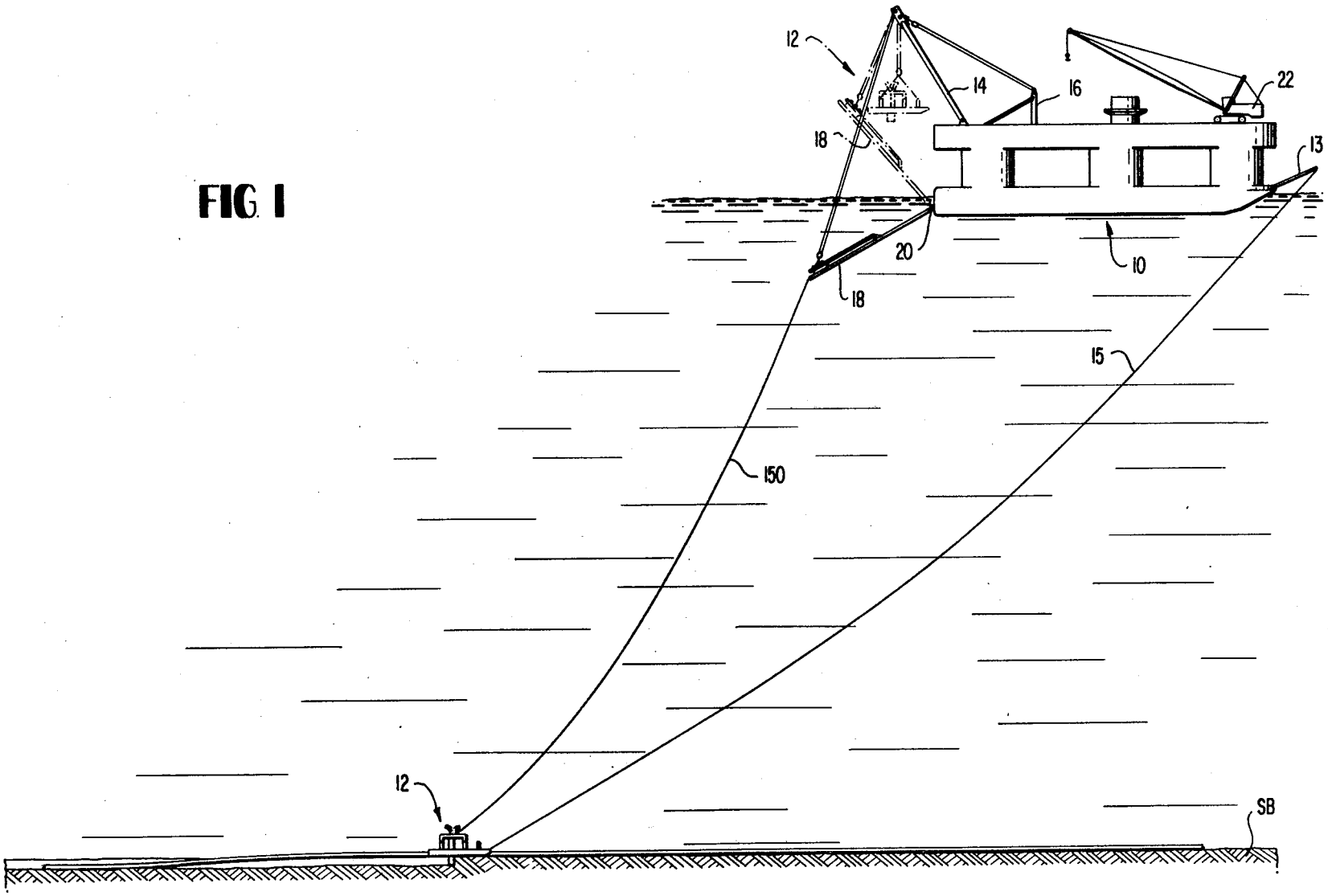

Referring now to the drawings, particularly to FIG. 1, there is illustrated a tender barge generally designated 10, carrying a sea sled and an eductor system generally designated 12 by means of an A frame 14 and a gantry 16. The A frame 14 also supports an extension 18 pivotally connected at 20 to the stern of tender barge 10 and movable between the full line and dashed line positions illustrated in FIG. 1. The extension 18 is adapted to support the fluid lines connecting between the tender barge and sea sled when the latter is employed along the sea bottom. The tender barge 10 also carries a crane 22 for use in locating the sea sled 12 from a position on the deck of tender barge 10 and in the water and also for removing the sea sled 12 from the water for positioning on the deck of the tender barge. A boom 13 is carried on the bow of barge 10 and tow cables 15 depend from boom 13 for connection with the sea sled and for towing the latter. Further details of the tender barge 10 are not believed necessary since the tender barge per se forms no part of the present invention. It is believed sufficient to note that the tender barge 10 serves to transport the sea sled to and from the work site, to two the sea sled 12 along the sea bottom designated SB in FIG. 1 during entrenching and pipeline burying operations, and to provide a surface floating carrier for personnel and equipment necessary to the operation of the sea sled and eductor system as described hereinafter.

Referring now particularly to FIGS. 2–5, sea sled 12 comprises a pair of generally cylindrical, laterally spaced, pontoons 24 structurally interconnected one to the other by a plurality of longitudinally spaced transversely extending trusses 26. Each truss 26 is comprised of vertical and diagonally upstanding members 28 and 30 respectively and transversely extending member 32 connecting between the upper ends of the vertical and diagonal members 28 and 30. Forwardly inclined struts 34 also support the forwardmost pair of trusses 26 while rearwardly inclined struts 36 support the aft truss 26. It will be appreciated that the foregoing described structure of the sled provides a clear area between the pontoons 24 whereby the pontoons are adapted to straddle a pipeline disposed on the sea bottom for reasons which will be appreciated from the ensuing description. The pontoons are compartmented and suitable valves are provided whereby the pontoons can be ballasted and deballasted.

A pair of transversely spaced, vertically extending, rises 40 upstand from each of the transverse members 32 of the aft and intermediate trusses 26 for supporting the entrenching and eductor apparatus, generally designated 41, carried by sled 12. A cross-over brace 42 interconnects the upper ends of the risers 40 carried by the intermediate truss 26. Additionally bracing for the aft risers 42 is provided by diagonally extending struts 44.

The entrenching and eductor apparatus 41 are carried by risers 40 for location at selected elevations relative to the shed. To accomplish this, the support for entrenching and eductor apparatus 41 is provided by a generally rectangular frame (FIG. 3) comprised of a pair of longitudinally extending frame members 46 and transversely extending frame members 48 interconnecting the opposite ends of members 46. A pair of lugs 50 projects forwardly from the opposite ends of forward cross member 48 and a similar pair of lugs 52 project rearwardly from the opposite ends of aft cross member 48. Along the aft side of each forward riser 40 and along the forward side of each aft riser 40 there is provided a pair of laterally spaced, vertically extending plates 60 having laterally registering vertically spaced openings 62 therealong. Gusset plates 64 are disposed between each pair of openings 62 to reinforce plates 60 and risers 40. The lugs 50 and 52 are disposed within the slots formed by the pairs of plates 60 in the forward and aft pairs of risers 40 respectively and lugs 50 and 52 have openings which register with the openings 62. A pair of laterally spaced longitudinally extending support tubes 68 are secured at opposite ends to members 48. Support tubes 68 are secured to transversely extending members 48 by clamps 74 which permit support tubes 68 to be positioned at selected transversely adjusted positions along members 48 for purposes as will become apparent from the ensuing description. Accordingly, the frame comprised of members 46, 48, and 68 and which frame rigidly supports the entrenching and eductor apparatus 41, may be selectively positioned along risers 40 at desired elevations by inserting bolts or pins 63 through the openings 62 of plates 60 and the registering openings of the lugs 50 and 52 as applicable.

Figure 6:
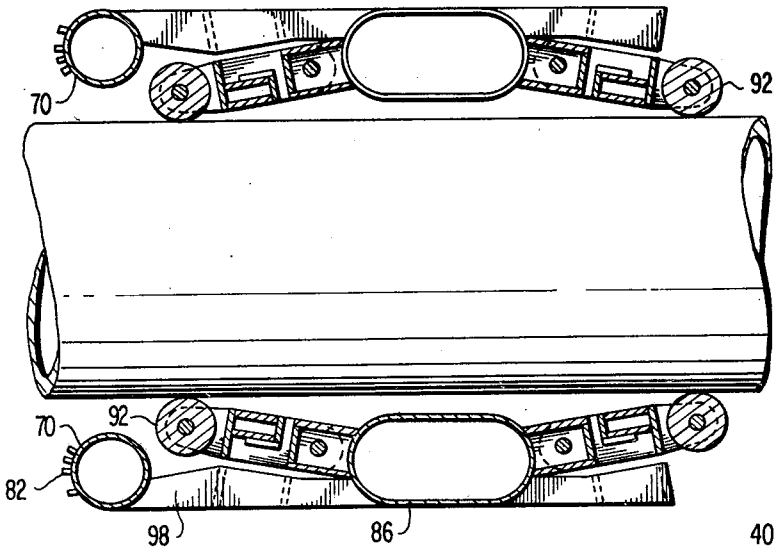
FIG. 6 is an enlarged fragmentary cross-sectional view thereof taken generally about on line 6—6 in FIG. 2.
Figure 3:
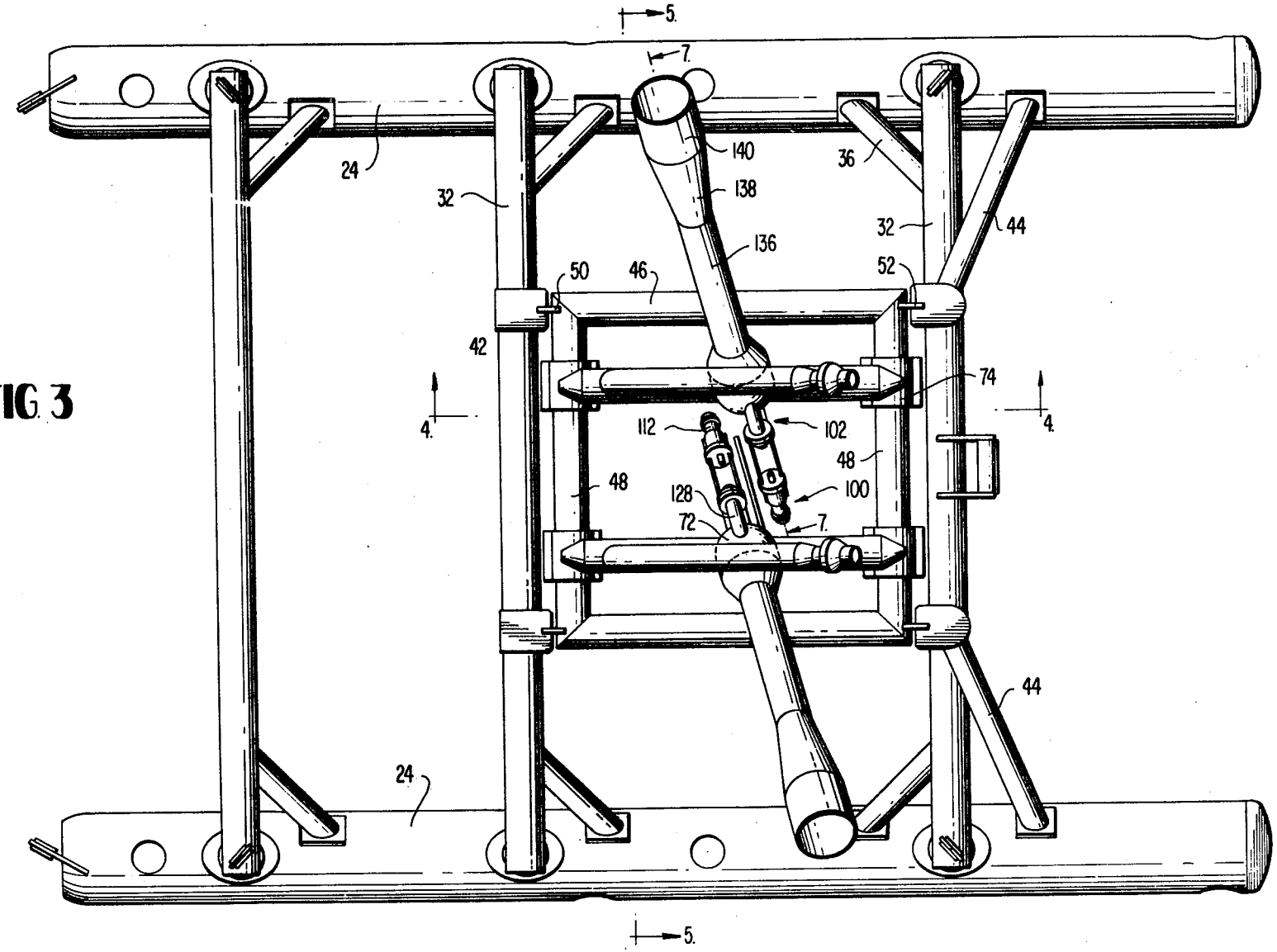
FIG. 3 is an enlarged top plan view thereof.
Figure 4:
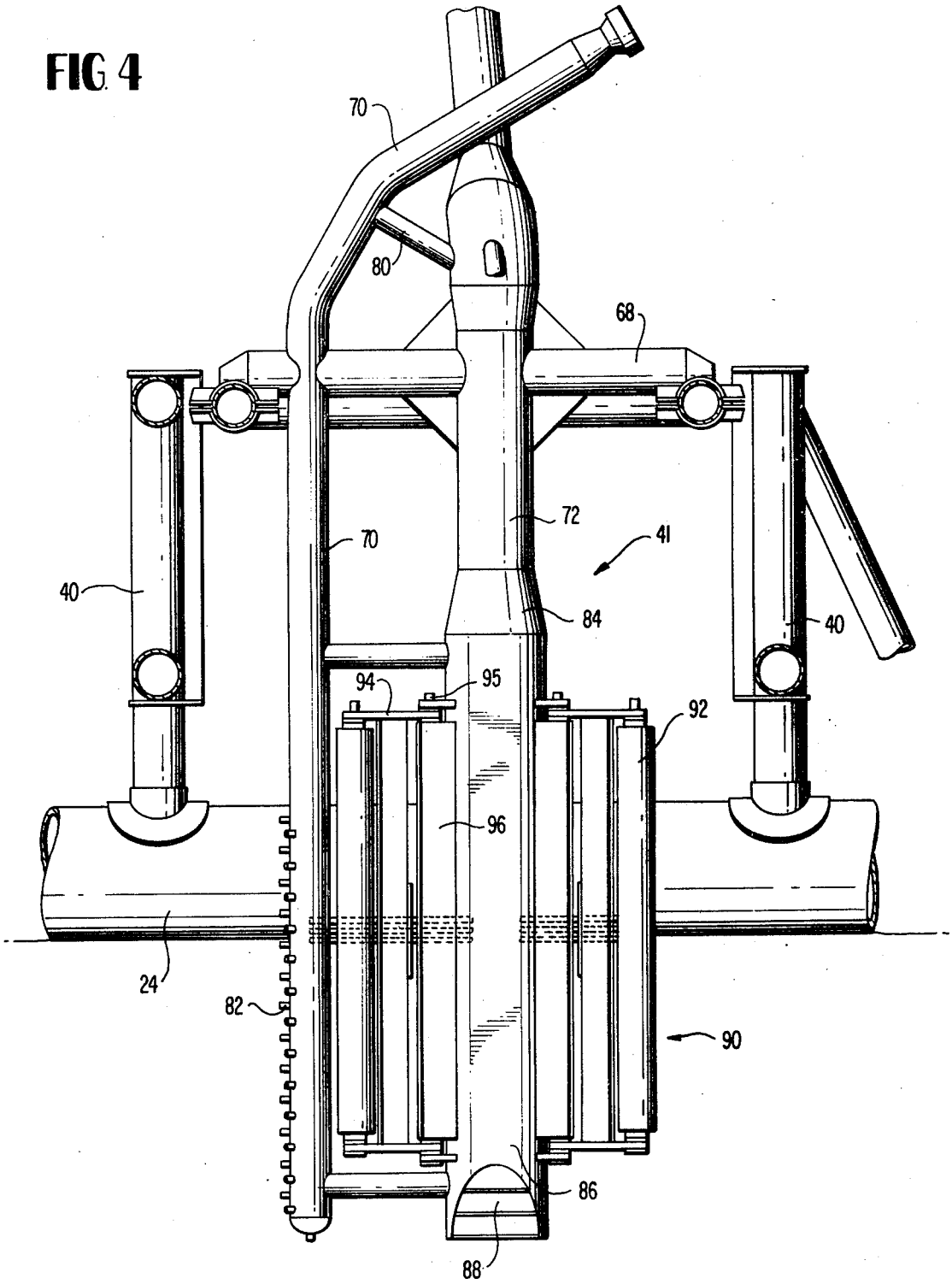
FIG. 4 is an enlarged fragmentary cross-sectional view taken generally about one line 4—4 in FIG. 3.
Figure 5:
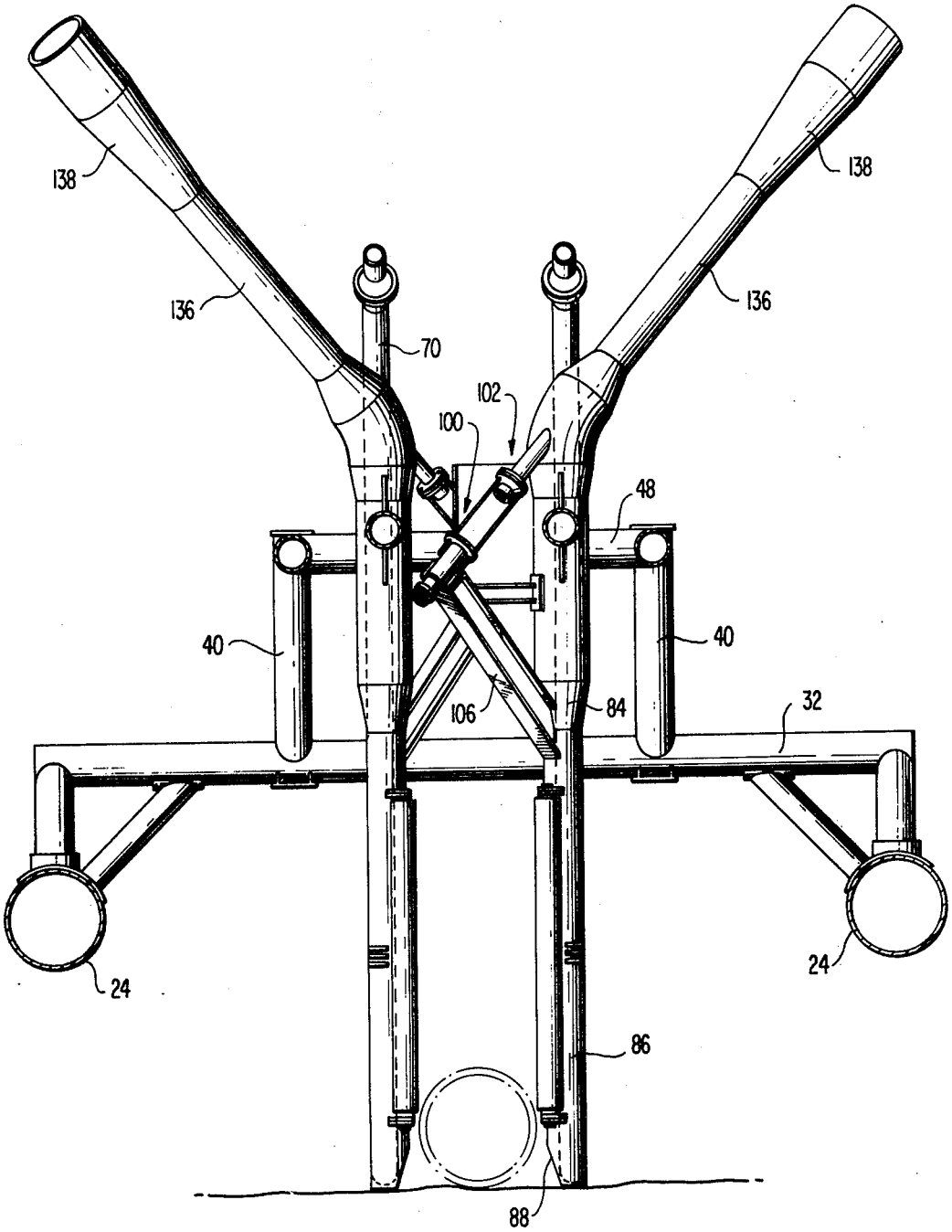
FIG. 5 is an enlarged end elevational view thereof.

The entrenching and eductor apparatus 41 is comprised of parts, for example jet tube pipes 70 and suction tubes 72 and other equipment, which are duplicated on opposite sides of sea sled 12 (excepted as otherwise noted) and therefore a description of the apparatus on one side of the sled will suffice as a description of both. Referring now particularly to FIGS. 4 and 6, the upper end of each jet tube 70 inclines upwardly and in an aft direction for connection with fluid lines connected at their opposite end to the tender barge 10 whereby fluid under pressure from tender barge 10 is pumped through tubes 70. Each jet tube 70 is structurally interconnected with the suction tube 72 on the like side of the sled by cross-bracing 80 and carries along its forward edge a plurality of jet nozzles 82 for ejecting the high pressure fluid flowing into tube 70 from tender barge 10 forwardly of the sled. The jet tubes 70 extend below pontoons 24 a distance approximating the depth of the trench to be dug for the pipeline. The nozzles 82 are spaced vertically along the tubes 72 such that they lie at elevations coincident with and below pontoons 24. Nozzles 82 are also spaced circumferentially about the tubes 70 and incline downwardly such that high pressure fluid flows in a downward direction both forwardly and inwardly to fluidize the sea bottom ahead of the tubes 70 and thereby form a trench between the jet tubes.

The eductor apparatus includes the generally circular section tube 72 which passes through a transition section 84 to form a slurry inlet pipe 86 substantially oblong in cross-section. The lower end of inlet pipe 86 is provided with an inlet 88 opening along the inner side thereof and through which opening large quantities of the slurry produced by the fluidization of the sea bottom enters for transmission through the suction pipe 72. Carried by each oblong inlet pipe section 86 is a roller assemblage 90 comprised of a roller 92 on each of the fore and aft sides of inlet pipe section 86. Opposite ends of each vertically disposed roller are carried by links 94 which in turn are pivotally carried by a shaft 95 pivotably mounted to a pivot housing 96. Housing 96 is secured to the inlet tube 86. A plurality of gusset plates 98 are also secured to inlet tube 86 and project in fore and aft directions on opposite sides thereof. The ends of the forward gusset plate 98 are also secured to the jet tube 70 to provide further support therefor. The forward and aft gusset plates carry load cells which interact with the pivotally mounted rollers 92 whereby the load exerted on either side of the sled by the pipeline can be determined.

Figures 7, 8:
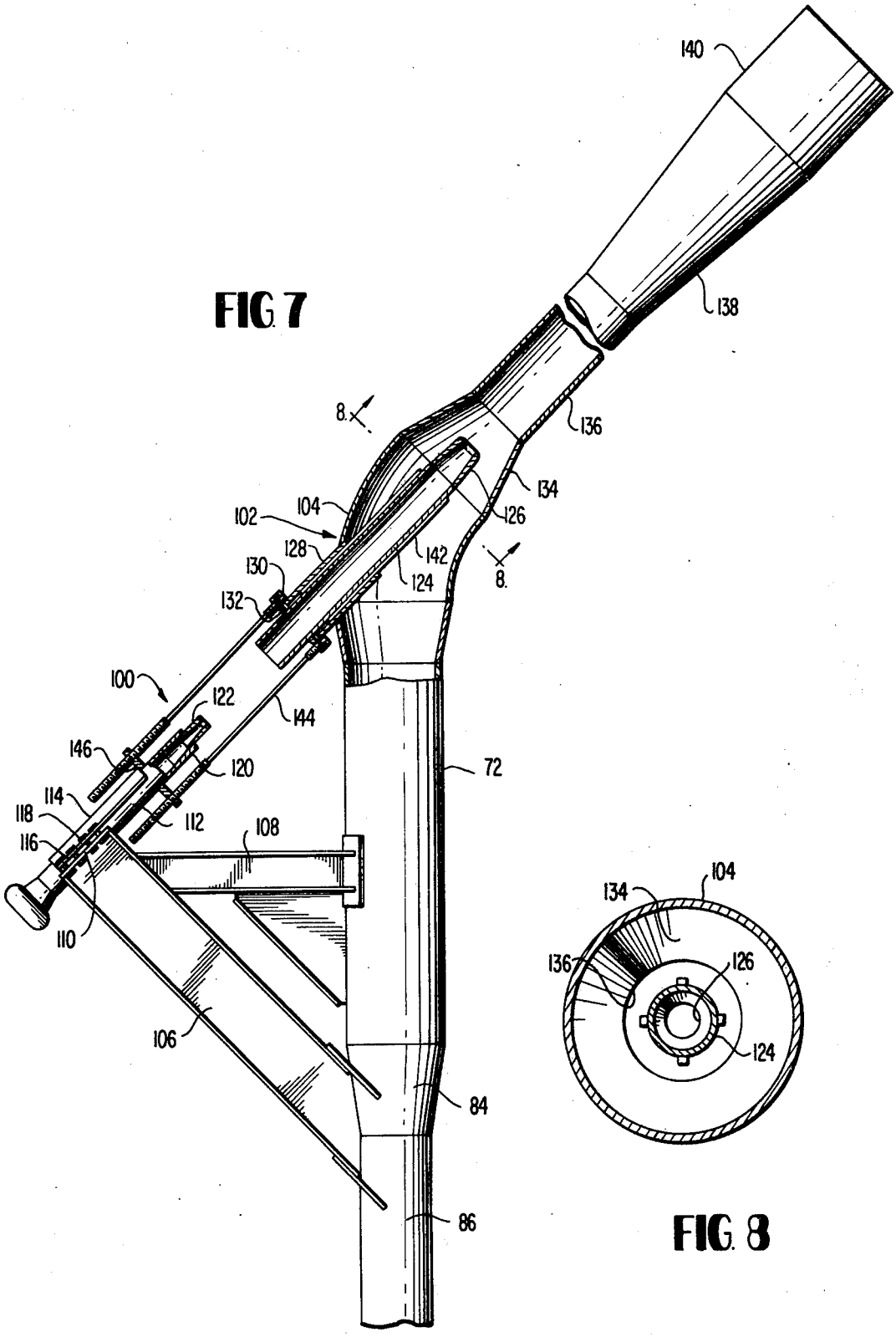
FIG. 7 is an enlarged side elevational view of a portion of the eductor system with parts broken out and in cross section for ease of illustration.
FIG. 8 is a cross-sectional view thereof taken generally about on line 8—8 in FIG. 7.

Referring now to FIGS. 7 and 8, the jet nozzle and jet pump for the decoder system on one side of the sled are illustrated in detail. Particularly, the eductor system includes a jet nozzle generally indicated 100, and a jet pump, generally indicated 102, the latter being disposed within an elbow section 104 of the outlet pipe 72.

The jet nozzle 100 is supported by a bracket 106 extending upwardly and inwardly from transition section 84 and also by horizontally inwardly extending bracket 108 secured to pipe 72. Bracket 106 supports a water supply pipe 112 for jet nozzle 100. Particularly, the outer end of bracket 106 terminates in a pair of flanges 110 on opposite sides of the water supply pipe 112.

An arcuate bracket 114 having lateral flanges 116 on opposite sides thereof overlies the water supply pipe 112 and bolts 118 cooperate with flanges 110 and 116 to secure supply pipe 112 to the support bracket 106. The forward end of the supply pipe 112 terminates in a nozzle holder 120 which, in turn, supports a jet nozzle 122.

Jet pump 102 is comprised of an eductor entry pipe 124 carrying, at its forward end, an eductor nozzle 126. A nozzle attachment 128 encompasses the lower end of the eductor entry pipe 124 and terminates in a flange 130. An annular support 132 is secured about the lower end of the re-entry pipe 124. From a review of FIG. 7, it will be seen that pump 102 is axially aligned with nozzle 100 and that the nozzle attachment 128 is secured to the wall of elbow section 104 of outlet tube 72 with the re-entry pipe 124 and nozzle 126 oriented to flow fluid axially through a venturi cone 134, an outlet pipe section 136, an eductor outlet cone 138 and a pipe outlet 140. Also, from a review of FIG. 3, it will be appreciated that the nozzle 100 and pump 102 on each side of the sled are oriented to discharge fluid from outlet 140 to a like side of the sled on which the corresponding pump and nozzle are associated.

Pipe 124 has a plurality of elongated bars 142 disposed longitudinally along its outer surface and at circumferentially spaced positions thereabout whereby pipe 124 is slidably received in nozzle attachment 128. A plurality of spindles 144 threaded at opposite ends interconnect the annular support 132 carried by slidable entry pipe 124 and an annular flange 146 secured to bracket 114 whereby pipe 124 is slidable in opposite directions within nozzle attachment 128 axially toward and away from nozzle 100 to selected axial distances relative thereto. Thus the gap between the nozzle 100 and pump 102 can be adjusted and this gap spacing bears on the power requirements and resulting suction as hereinbelow amplified.

It will be appreciated that the sea sled and eductor system hereof are utilized after the pipeline has been laid along the sea bottom and that it is desirable to locate the pipeline within a trench and cover the trench. To accomplish this, the sea sled 12 is ballasted and lowered from the tender barge 10 such that the rollers 92 on the port and starboard eductor assemblies straddle the pipeline P as illustrated in FIG. 6. High pressure fluid, i.e., sea water, is then supplied to the jet tubes 70 from the tender barge 10 through fluid lines 150 (FIG. 1) supported by extension 18. The high pressure fluid issuing from jets 82 tends to fluidize the sea bottom directly below the pipeline and in front of sled 12. The sled thus sinks to a depth wherein pontoons 24 rest on the sea bottom on opposite sides of the pipeline. The sled is thus ready to be towed by line 15 connected to the bow of the tender barge. As the barge is towed, high pressure fluid, i.e., seat water, is also supplied jet nozzles 100 via suitable conduits from the tender barge 10. Each of nozzles 122 supplies a high pressure low volume fluid flow across the gap or space between it and the inlet to the jet pump 102. That is, the high pressure energy of the fluid flowing through nozzle 100 is dissipated to some extent in the ambient medium while also entraining ambient fluid as the fluid flows from nozzle 122 to jet pump 102. Thus, the jet nozzle flow and the entrained fluid pass through pump 102 and pump nozzle 126. This results in a high volume low pressure flow through nozzle 126 into the venturi cone 134 and the eductor outlet. The flow issuing from the jet pump 102 causes a suction at the inlet opening 86 of pipe 72 whereby slurry produced by the fluidization of the sea bottom by jet nozzles 82 enters inlet 88 and flows upwardly through pipe sections 86 and 72 for delivery from the outlet pipe 140 on one side of the trench.

A preferred embodiment of the present invention provides a jet nozzle having a throat diameter of one inch, a jet pump inlet having a diameter of $5\frac{3}{4}$ inches and a jet pump throat having a diameter of $3\frac{1}{2}$ inches. The eductor pipe 72 is 20 inches in diameter, the elbow 104 is 24 inches in diameter with a 45° bend, the venturi cone 134 is 16 inches long and provides a transition from a 24 to a 14 inch diameter, the outlet pipe section 136 is 7 feet long, the eductor outlet cone 138 is 3 feet 10 inches long and forms a transition from 14 to 24 inches in diameter, and the outlet pipe 140 is 2 feet long with a 24 inch diameter forming the eductor pipe. Preferably, the jet pump nozzle exit lies axially at a location intermediate the venturi cone.

Since prior airlift systems for removal of slurries are not satisfactory for use in depths beyond 150–200 feet and low volume high pressure water systems are presently available to supply an eductor from a tender barge, the present invention utilizes and arranges the aforedescribed novel jet nozzle and pump in a manner to advantageously fully utilize such available low volume high pressure water to remove a predetermined quantity of slurry from the trench. As noted previously, a high pressure water jet is necessary to generate the required lifting or suction capacity. However, utilization of a high pressure water jet to accomplish the desired flow rate would cause sever cavitation problems. The jet nozzle and pump arrangement disclosed herein solves these problems while maintaining desired flow rates and pressures. Particularly, by permitting the fluid from the high pressure jet to expand in the surrounding ambient fluidor sea water whereby the high energy available is reduced and by properly spacing the jet nozzle from the inlet of the jet pump, the desired removal rates can be obtained with the cavitation problem minimized or eliminated. For example, the sea sled and eductor system hereof is adapted for use with available equipment which provides 2000 gallons per minute and 2500 pounds pressure at the operating depth. With this available power, the sea sled can remove over 20,000 gallons per minute of slurry from the trench at a depth of 280 feet.

Figure 9:
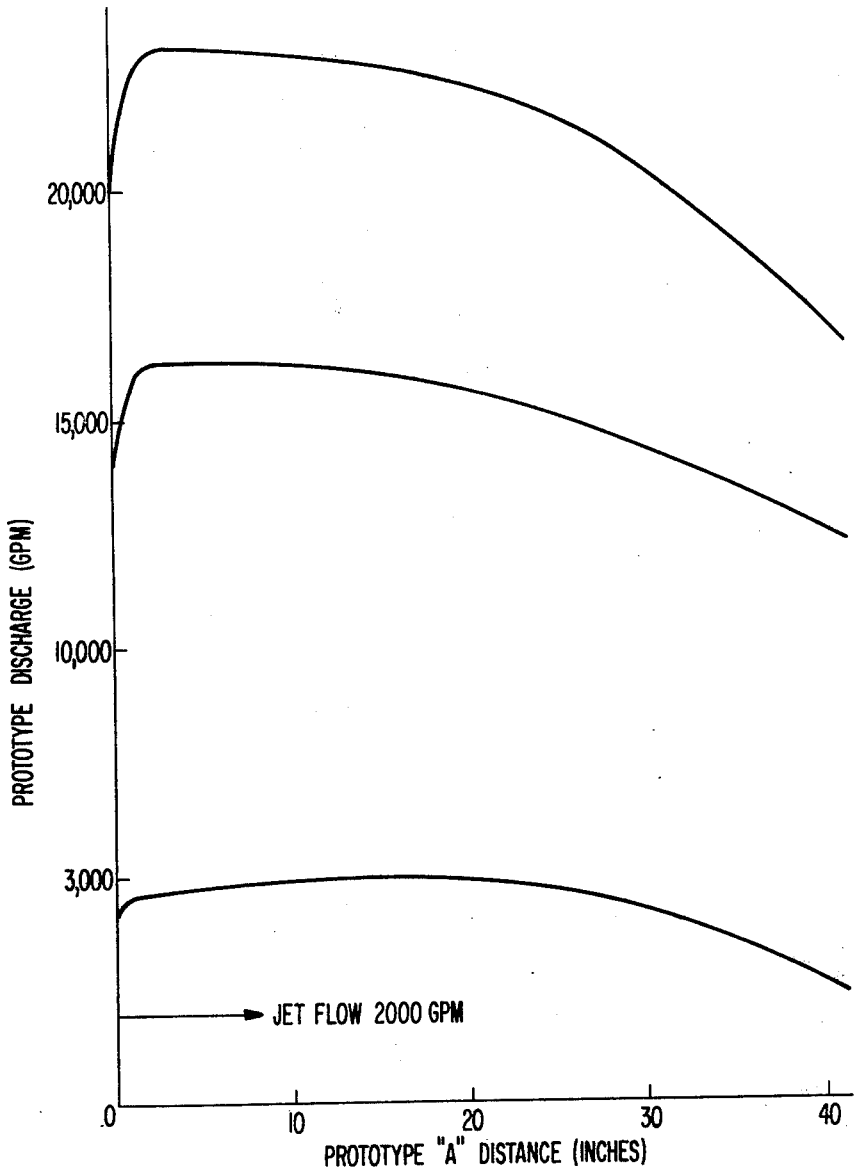
FIG. 9 is a graphical illustration of the flow rates achieved with a preferred embodiment of the present invention.

With the foregoing parameters, the desired discharge flow rates are achieved. This is illustrated in FIG. 9 wherein the flow rates through the pump, the eductor pipes and the discharge of the eductor pipes are indicated as a function of the gap distance, i.e., the distance between the jet nozzles and the inlets of the jet pumps. The lower curve designated $Q_p$ indicates the rate of flow of the entrained water through the jet pumps 102, i.e., the combined flow from the jet nozzles and the entrained flow derived therefrom, as a function of gap distance. The intermediate curve designated $Q_s$ indicates the rate of flow of the slurry through the eductor pipes as a function of gap distance. The uppermost curve $Q_p$ indicates the total discharge from the outlet pipes as a function of gap distance. Note the sharp increase in the flow rate illustrated by each curve and particularly the total flow rate as the jet nozzle is moved away from the jet pump inlet. Once spaced several inches from the jet pump inlet substantially insignificant changes occur in the flow rates as the gap is increased to about 20–25 inches whereupon the flow rate falls off upon further increase in gap distance. As noted previously, however, close spacing of the jet nozzle and the jet pump inlet causes cavitation problems in the jet pump. Since the jet nozzle can be spaced a considerable distance from the jet pump inlet without significant change in the flow rates, the gap between the jet nozzle and the jet pump inlet is preferably located at 12 inches and preferably within a range of 2 to 30 inches depending upon other parameters, i.e., depth of water, nozzle configuration, etc.

It will be appreciated that certain of the prior pipe burying systems require two sets of pumps on the lay barge. One set of high pressure fluid pumps is utilized for the jetting nozzles while another set is utilized for use with the eductor system. The present invention, however, utilizes high pressure fluid emanating from a single pump source for both the jetting and eductor systems. The configuration of the eductor hereof is such that the pump requirements therefor are altered to the same as required for the jetting action. That is, the high pressure fluid delivered to the eductor system is transformed to the necessary low pressure through the foregoing described nozzle arrangement.

The foregoing described sea sled has been utilized in actual pipe entrenching and burying operations in the North Sea. During initial operations, the sea sled has entrenched and buried in 360 feet of water 18,000 feet of 34 inch pipeline with a two inch concrete coating in a twenty-four hour period. For operation at this depth, the sea sled is preferably towed from the bow of the tender barge 10 by a tow line 15 connected to the bow of the sea sled. The fluid lines 150 provide the high pressure fluid from the tender barge to the jets and to the eductor system.

Figure 1A:
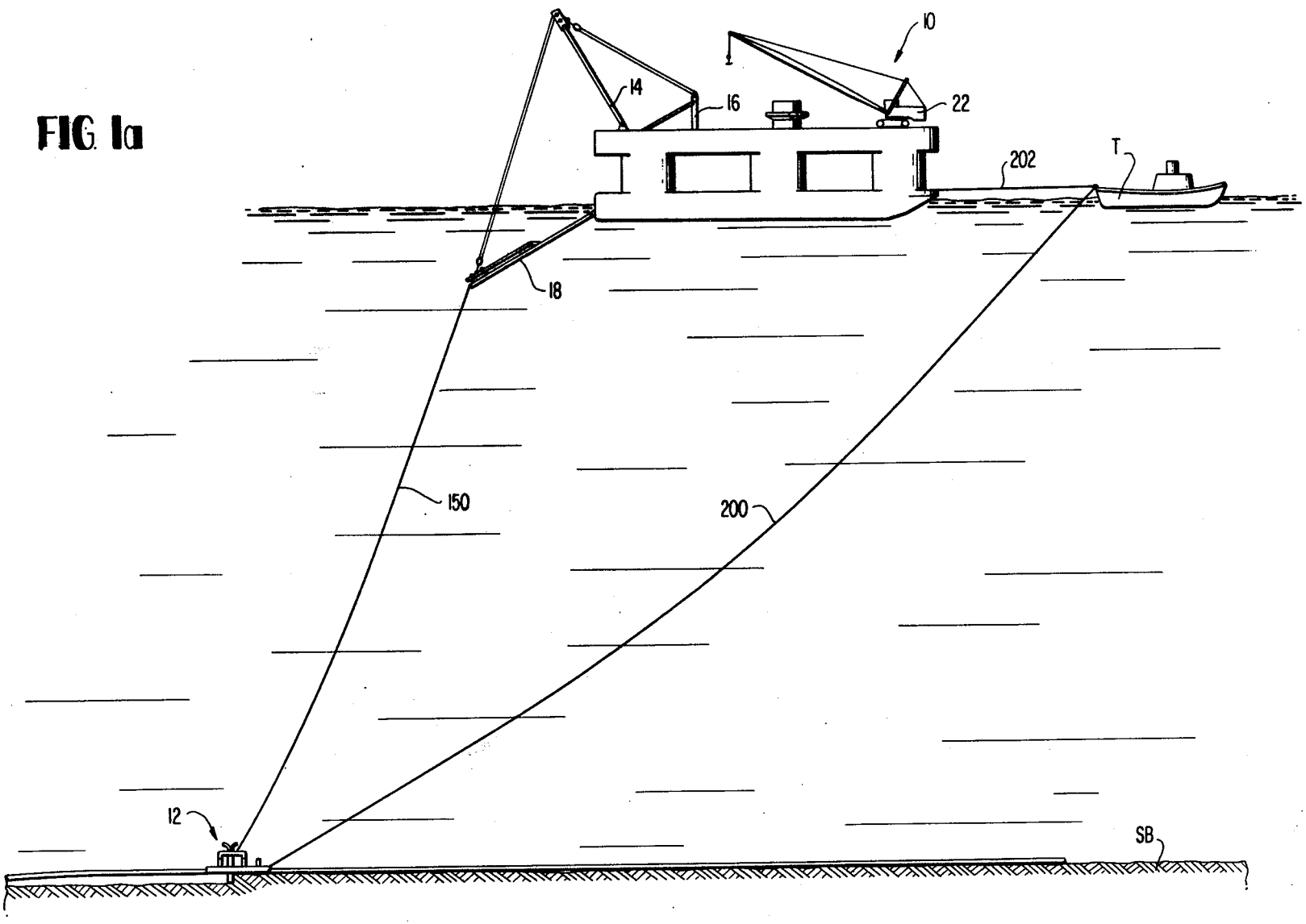
Figure 2:
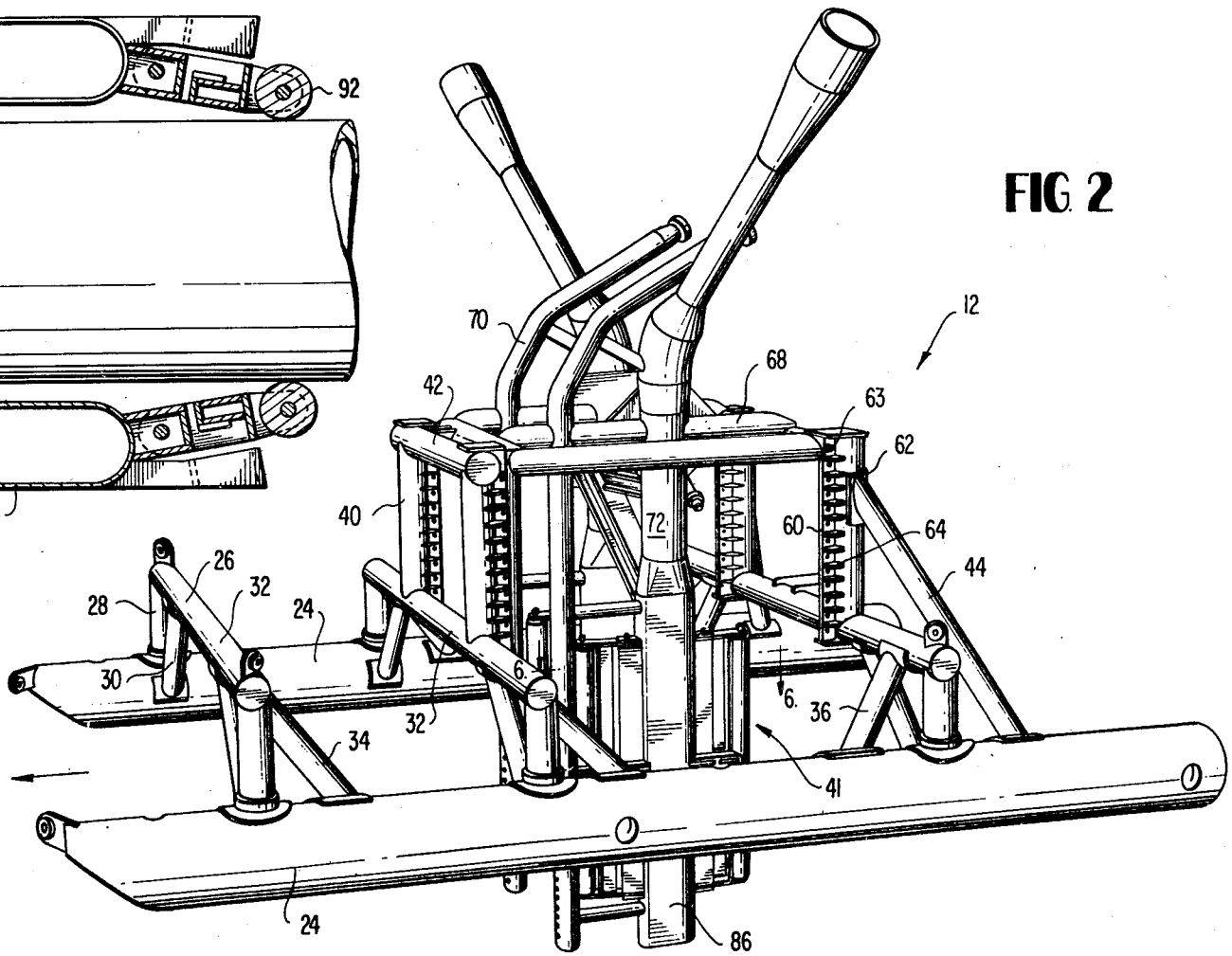
FIG. 2 is a perspective view of the sea sled and eductor system constructed in accordance with the present invention.

In particularly deep water pipe entrenching and burying operations, the sea sled is towed from a tug which in turn also tows the bury barge. This operation is illustrated in FIG. 1A wherein the tug designated T tows sea sled 12 by a towline 200 while simultaneously towing the bury barge by tow line 202. The tug is then necessarily in advance of the sea sled and enables the sea sled to be drawn along the sea bottom without significant lifting motion. Preferably the tow line 15 or 200 as the case may be for either relatively shallow depth or deep water pipe entrenching and burying operations is formed of a chain weighted to prevent the bow of the sea sled from rising. Preferably, cable depends from the tender barge or tug as the case may be and heavy chain is attached to the end of the cable adjacent the sea sled. This chain weights the bow of the sea sled and maintains it on the sea bottom.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A device for making a trench in a sea bottom and for removing slurry formed during making such trenches, adapted for use in conjunction with a sled drawn by a vessel and moving on the sea bottom, said device comprising: at least one outlet nozzle with means for supplying high pressure water through same by means of a hose from the vessel for production of a trench by swilling: at least one suction tube having associated therewith a jet pump operated also from the same high pressure water supply used to displace slurry made up of spoil mixed with water; said jet pump comprising two nozzles which are arranged substantially coaxially in tandem with an adjustable spacing between the nozzles providing a free intermediate space which is in communication with surrounding water in trenching operation, the forward of these nozzles being introduced from the side of such suction tube into the same substantially coaxially at a bent portion of the suction tube.

2. A device in accordance with claim 1, wherein the free intermediate space between said two nozzles is between 2 and 30 inches.

3. A device as in claim 1, such jet pump including means for moving at least one nozzle with respect to the other thereby enabling adjustment of the spacing between said forward nozzle and the second nozzle.

4. A device according to claim 1, further comprising a sled having a base structure adapted to slide on the sea bottom, and further including means for adjusting said suction tube and the inlet thereof relative to said base structure and thereby relative to sea bottom.

5. A device according to claim 4, in which the sled has a base structure comprising a pair of laterally spaced pontoons, and means for ballasting and deballasting said pontoons.

6. A device for making trenches in the bottom of the sea and for removing slurry formed during making such trenches comprising: support means adapted to be drawn by a vessel and move on the sea bottom; a plurality of outlet nozzles on said support means for high pressure water to be supplied through same by means of a hose from the vessel for the production of the trench by swilling; a plurality of suction tubes, each having associated therewith a jet pump operated also from the same high pressure water supply used for displacing slurry made up of trenching spoil mixed with water; each such jet pump comprising two nozzles which are arranged substantially coaxially in tandem with means for adjustable spacing between the nozzles to provide a free intermediate space which is in communication with the surrounding seawater in trenching operation, each said suction tube having a bent portion with the front nozzle of said tandem nozzles being introduced at the bent portion of the suction tube from the side thereof and into the same substantially coaxially.

7. A device in accordance with claim 6, wherein in each of said jet pumps the free intermediate space between said two nozzles in tandem is between 2 and 30 inches.

8. A device as in claim 6, wherein each jet pump includes means for moving at least one nozzle with respect to the other thereby enabling adjustment of the spacing between the front nozzle and second nozzle of such jet pump.

9. A device according to claim 6, further comprising a sled incorporating a base structure and including means adapted to slide the sled on the sea bottom, and further including means for adjusting each of said suction tubes and the inlet thereof relative to said base structure and thereby relative to sea bottom.

10. An entrenching and pipeburying system comprising:

a surface floating vessel, a sea sled for excavating a trench below a pipeline laid along the sea bottom and for removing the slurry formed by the excavation; means carried by said vessel for raising and lowering the sea sled respectively from and to the sea bottom; means carried by said sled for excavating the trench and including a plurality of jet nozzles directed to flow high pressure fluid below the pipeline to fluidize the sea bottom and form a slurry; means carried by said sled for removing the slurry including a plurality of suction conduits each having an inlet disposed below said sled and a discharge portion; a plurality of jet pumps carried by said sea sled, each jet pump including a pump nozzle having an inlet external to each suction conduit and exposed to the ambient fluid with said pump nozzle having an outlet within said conduit for delivery of fluid to said suction conduit intermediate said inlet and discharge portions thereof and a second nozzle carried by said sled external to said conduit and spaced a predetermined distance from said inlet of said first-mentioned pump nozzle to provide a free space; means carried by said surface vessel for supplying low volume high pressure fluid to each said second-mentioned nozzle of each said jet pump and to said jet nozzles, each said second-mentioned nozzle being disposed to flow the supply fluid towards said first-mentioned pump nozzle inlet and across the space therebetween to entrain ambient fluid and deliver the entrained fluid and at least a portion of the supply fluid through the first-mentioned pump nozzle into said conduit.

11. An entrenching and pipeburying system comprising:

a surface floating vessel; a sea sled for excavating a trench below a pipeline laid along the sea bottom and for removing the slurry formed by the excavation; means carried by said vessel for raising and lowering the sea sled respectively from and to the sea bottom; means carried by said sled for excavating the trench and including a plurality of jet nozzles directed to flow high pressure fluid below the pipeline to fluidize the sea bottom and form a slurry; means carried by said sled for removing the slurry including a plurality of suction conduits each having an inlet disposed below said sled and a discharge portion; each suction conduit having associated therewith a jet pump operated also from the same high pressure water supply used for displacing slurry; each such jet pump comprising two nozzles which are arranged substantially coaxially in tandem with means for spacing the nozzles apart to provide an intermediate free space which is in communication with the surrounding seawater in trenching operation, each said suction conduit having a bent portion with the front nozzle of said tandem nozzles being introduced at a bent portion of the suction conduit from the side thereof and into the same substantially coaxially; means carried by said surface vessel for supplying low volume high pressure fluid to each said second-mentioned nozzle of each said jet pump, each said second-mentioned nozzle being disposed to flow the supply fluid towards the inlet of said front nozzle and across the space therebetween the entrain ambient fluid and deliver the entrained fluid and at least a portion of the supply fluid through said front nozzle into said conduit.

12. A device in accordance with claim 11, wherein in each of said jet pumps the free intermediate space between said two nozzles in tandem is between 2 and 30 inches.

13. A device as in claim 11, wherein each jet pump includes means for moving at least one nozzle with respect to the other thereby enabling adjustment of the spacing between the front nozzle and the second nozzle of such jet pump.

14. Apparatus for use in making a trench in a sea bottom and for removing spoil formed during making such a trench, said apparatus comprising in combination;

a surface floating vessel; a tow for excavating a trench for a pipeline laid along the sea bottom and for removing the spoil formed by the excavation, said tow having a base structure adapted to slide on the sea bottom; means carried by said vessel for raising and lowering the tow, respectively, from and to the sea bottom; means carried by said tow for excavating the trench and including outlet nozzles with means for receiving from the vessel a high pressure supply of water and for emitting said high pressure water supply through said nozzles for production of a trench by jetting;

means for removing the spoil and carried by said tow, said spoil removing means being in duplicate and being so supported by the tow as to be in substantially side by side relationship relative to the direction of slide of the tow, each spoil removing means comprising a suction tube having a bent portion merging with an eductor tube section, a jet pump associated with said suction tube and comprising first and second nozzles which are arranged substantially coaxially in tandem, at least part of the jet pump being exposed to ambient water during a trenching operation, the first nozzle projecting through a side of said second suction tube into the bent portion and extending in the direction of the outlet of the educator tube section, and means associated with the second nozzle for receiving said high pressure water supply from the vessel; and guide means carried by said base structure for maintaining said tow in alignment with the pipeline as the trench is excavated and adapted to straddle the pipeline; a frame for supporting said trenching means, said spoil removal means and said guide means; and means for adjusting the elevation of said frame relative to said base structure thereby to adjust the elevation of said outlet nozzles, said suction tube inlets and said guide means relative to said base structure; each of said suction tube inlets having an aperture opening in a lateral inward direction relative to the longitudinal sides of the tow, with said apertures lying in substantial lateral register one with the other.

15. Apparatus as claimed in claim 14, in which the first nozzle of each spoil removing means projects through the side of the associated suction tube into the bent portion thereof and extends substantially coaxially with the associated eductor tube section.

16. Apparatus as claimed in claim 14, in which each yet pump includes means for moving at least one of the associated first and second nozzles axially relative to the other nozzle.

17. Apparatus according to claim 14, wherein said jet pump has a free intermediate space between adjacent portions of said first and second nozzles which is intended to be exposed to ambient water in a trenching operation.

18. Apparatus according to claim 17, wherein the free intermediate space between adjacent portions of said first and second nozzles is between 2 and 30 inches.

19. Apparatus as claimed in claim 18, wherein the jet pump includes means for moving at least one nozzle axially relative to the other.

20. Apparatus for use in making a trench in a sea bottom and for removing spoil formed during making such a trench, said apparatus comprising:

at least one suction tube having a bent portion merging with an eductor tube section;

a jet pump associated with said suction tube and comprising first and second nozzles which are arranged substantially coaxially in tandem, such that there is a free intermediate space between adjacent portions of said first and second nozzles which is intended to be exposed to ambient water during a trenching operation, the first nozzle projecting through a side of said suction tube into the bent portion and extending in the direction of the outlet of the eductor tube section; and means associated with the second nozzle for receiving a high pressure supply of water to cause said water supply to flow through said nozzles to entrain ambient water and to cause spoil produced during the trenching operation to flow through the suction tube to be entrained with said water supply and ambient water and discharged through the eductor tube section.

21. Apparatus according to claim 20, wherein the free intermediate space between adjacent portions of said first and second nozzles is between 2 and 30 inches.

22. Apparatus as claimed in claim 21, wherein the jet pump includes means for moving at least one nozzle axially relative to the other.

* * * * *

UNITED STATES PATENT AND TRADEMARK OFFICE

CERTIFICATE OF CORRECTION

PATENT NO. : 4,165,571

DATED : August 28, 1979

INVENTOR(S) : Nuke M. Chang and Elmer R. Remkes

It is certified that error appears in the above-identified patent and that said Letters Patent are hereby corrected as shown below:

Column 3, line 8 "one" should read --on--.
Column 3, line 43, "two" should read --tow--.
Column 5, line 27, "decoder" should read --eductor--.
Column 6, line 27, "seat" should read --sea--.

Column 10, line 35, (claim 11), "the" (second occurence) should read --to--.
Column 11, line 10 (claim 14), "educator" should read --eductor--.
Column 11, line 33 (claim 16), "yet" should read --jet--.

Signed and Sealed this

First Day of April 1980

[SEAL]

Attest:

SIDNEY A. DIAMOND

Attesting Officer

Commissioner of Patents and Trademarks